US005506466A

United States Patent [19]

Shoda et al.

[11] Patent Number: 5,506,466

[45] Date of Patent: Apr. 9, 1996

[54] COLOR CATHODE-RAY TUBE

[75] Inventors: Akira Shoda, Gunma; Yoshio Suzuki, Fukaya; Shoichi Yokoyama, Hanyu; Osamu Takahashi, Fukaya, all of Japan

[73] Assignee: Kabushiki Kaisha Toshiba, Kawasaki, Japan

[21] Appl. No.: 314,690

[22] Filed: Sep. 29, 1994

[30] Foreign Application Priority Data

Sep. 30, 1993 [JP] Japan ..... 5-243475

[51] Int. Cl.[6] ..... H01J 29/07

[52] U.S. Cl. ..... 313/402; 313/404; 313/407

[58] Field of Search ..... 313/402, 404, 313/407

[56] References Cited

U.S. PATENT DOCUMENTS

| | | | |
|---|---|---|---|
| 3,944,867 | 3/1976 | Kaplan | 313/403 |
| 4,122,368 | 10/1978 | Masterton | 313/403 |
| 4,504,764 | 3/1985 | Sakamoto et al. | 313/407 X |
| 4,780,641 | 10/1988 | Hashiba et al. | 313/407 X |
| 5,391,957 | 2/1995 | Fendley | 313/402 |
| 5,394,051 | 2/1995 | Lerner | 313/402 X |

FOREIGN PATENT DOCUMENTS

| | | | |
|---|---|---|---|
| 6267448 | 9/1994 | Japan | 313/402 |
| 2000367 | 1/1979 | United Kingdom . | |
| 2260856 | 4/1993 | United Kingdom . | |

*Primary Examiner*—Sandra L. O'Shea
*Assistant Examiner*—Ashok Patel
*Attorney, Agent, or Firm*—Cushman Darby & Cushman

[57] ABSTRACT

A shadow mask of a color cathode ray tube includes a mask body having a rectangular effective area with a large number of electron beam apertures, a non-effective area surrounding the effective area, and a skirt portion extending from a peripheral portion of the non-effective area. The mask body has a belt-shaped reinforcing bead extending between two end edges of the mask body, which are in parallel to the vertical axis, through a central portion of the mask body and projecting from the effective area toward a phosphor screen. The reinforcing bead is formed such that a projecting height thereof is gradually decreased from the central portion of the mask body toward the two end edges of the mask body and such that the projecting height thereof at boundaries between the effective and non-effective areas becomes about not more than ⅔ the height of the reinforcing bead at the central portion of the mask body.

8 Claims, 3 Drawing Sheets

COLOR CATHODE-RAY TUBE

BACKGROUND OF THE INVENTION

1. Field of the Invention

The present invention relates to a color cathode-ray tube and, more particularly, to a color cathode-ray tube in which a reinforcing bead is formed on the effective area of a shadow mask to improve the mechanical strength of the shadow mask.

2. Description of the Related Art

Generally, a color cathode-ray tube has an envelope constituted by a substantially rectangular spherical panel and a funnel integrally bonded to this panel. A phosphor screen comprising dots or stripes of three-color phosphor layers that emit blue, green, and red light components is formed on the inner surface of the panel. A rectangular shadow mask is arranged on the inner side of the phosphor screen to oppose it. The shadow mask has a rectangular mask body and a mask frame attached to the skirt portion of the mask body. The mask body has a rectangular effective area which is formed spherically to have a predetermined radius of curvature and in which a large number of electron beam apertures are formed with a predetermined arrangement, and a non-effective area which is located around the effective area and in which no electron beam apertures are formed. The skirt portion is formed continuously to the non-effective area. The shadow mask is supported on the inner side of the panel such that its effective area opposes the phosphor screen, by engaging a frame holder, attached to the mask frame, with stud pins provided on the panel. An electron gun for emitting three electron beams toward the phosphor screen is disposed in the neck of the funnel.

The shadow mask serves to select three electron beams emitted from the electron gun so that they are correctly land on the corresponding ones of the three-color phosphor layers. In the cathode-ray tube, the three electron beams emitted from the electron gun are deflected by a magnetic field generated by a deflecting yoke which is mounted on the outer surface of the funnel, and the deflected electron beams are selected by the shadow mask to scan the phosphor screen in the horizontal and vertical directions, thereby displaying a color image.

In color cathode-ray tubes having this arrangement, one having a flat screen is recently put into practical use. In the color cathode-ray tube of this type, as the screen surface is made flat, the effective area of the shadow mask is also made flat. Therefore, doming of the effective area toward the phosphor screen, which occurs when the shadow mask is subjected to thermal expansion by impingement of the electron beams against the shadow mask, becomes large. In this case, landing errors among the three electron beams on the three-color phosphor layers are large, leading to a degradation in image quality.

SUMMARY OF THE INVENTION

The present invention has been made in view of the above problems, and has its object to provide a color cathode-ray tube in which doming of the shadow mask is sufficiently suppressed, thereby preventing a degradation in outer appearance of the phosphor screen and the degradation in image quality.

In order to achieve the above object, according to the present invention, there is provided a color cathode-ray tube comprising: a face panel having a phosphor screen formed on an inner surface thereof; and a shadow mask disposed to oppose the phosphor screen at a predetermined gap. The shadow mask comprises: a mask body having a substantially rectangular effective area having a large number of electron beam apertures through which electron beams pass, a non-effective area surrounding the effective area, and a skirt portion extending from the peripheral portion of the noneffective area; and a mask frame mounted on the skirt portion of the mask body. The mask body has a center coinciding with a tube axis, horizontal and vertical axes extending through the center, and a belt-shaped reinforcing bead extending between two end edges of the mask body, with respect to the horizontal axis, through a central portion of the mask body and projecting from the effective area toward the phosphor screen. The reinforcing bead is formed such that its projecting height is gradually decreased from the central portion of the mask body toward the two end edges of the mask body, and such that its projecting height at boundaries between the effective and non-effective areas become about ⅔ or less the height of the reinforcing bead at the central portion of the mask body.

According to the present invention, further, the reinforcing bead is formed such that its projecting height h at the central portion of the mask body satisfies $0.1 \leqq h \leqq 3t$ where t is the thickness of the mask body.

When the reinforcing bead is provided at the shadow mask body, as described above, doming of the shadow mask can be sufficiently suppressed. Simultaneously, when the height of the reinforcing bead is gradually decreased from the central portion of the effective area toward the two end edges of the mask body with respect to the horizontal axis, i.e., toward the boundaries between the non-effective area and the skirt portion, and when the height of the reinforcing bead at the boundaries between the effective and non-effective areas is set to ⅔ or less the height of the reinforcing bead at the central portion of the effective area, a difference in height between the effective area at the peripheral portion of the mask body and the reinforcing bead can be decreased, so that a disorder in arrangement of the phosphor layers can be decreased. Accordingly, a degradation in quality of the outer appearance of the phosphor screen can prevented, and a degradation in image quality caused by beam landing errors can be prevented.

When the height h of the reinforcing bead at the central portion of the effective area is set to satisfy a relationship $0.1t \leqq h \leqq 3t$, a shadow mask which has a necessary doming suppressing function and which can prevent a degradation in outer appearance of the phosphor screen and a degradation in image quality can be easily formed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 6 show a color cathode ray tube according to an embodiment of the present invention, in which:

FIG. 1 is a sectional view of the entire portion of this color picture tube, FIG. 3 is a sectional view schematically showing a mold for molding the mask body of the shadow mask, FIG. 4 is a graph showing the relationship between the height of the reinforcing bead of the shadow mask and the purity drift (PD), FIG. 5 is a plan view of the shadow mask for explaining a method of measuring the purity drift of the color picture tube, and FIG. 6 is a graph showing a comparison between the purity drift (PD) of a color cathode-ray tube having a shadow mask formed with a reinforcing bead and the purity drift of a color cathode-ray tube having a shadow mask not formed with a reinforcing bead;

FIGS. 8A and 8B show a shadow mask having a reinforcing bead according to a second modification, in which:

FIG. 8A is a plan view of this shadow mask, and

FIG. 8B is a sectional view of this shadow mask taken along its Y axis; and

FIGS. 9A and 9B show a shadow mask having a reinforcing bead according to a third modification, in which:

FIG. 9A is a plan view of this shadow mask, and

FIG. 9B is a sectional view of this shadow mask taken along its Y axis.

DETAILED DESCRIPTION OF THE PREFERRED EMBODIMENTS

A color cathode-ray tube according to a preferred embodiment of the present invention will be described in detail with reference to the accompanying drawings.

Figure 1:
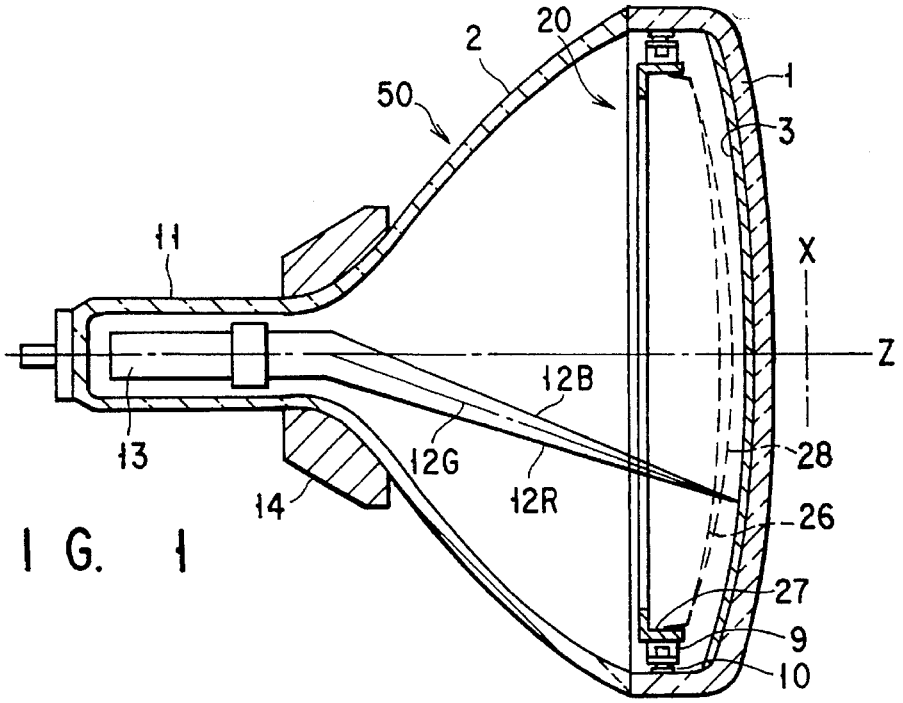

As shown in FIG. 1, the color cathode-ray tube has an envelope 50 comprising a rectangular spherical face panel 1 and a funnel 2 integrally bonded to the face panel 1. On the inner surface of the face panel 1 is formed a phosphor screen 3 comprising vertically elongated stripes of three-color phosphor layers that emit blue, green, and red light components. In the envelope 50, a rectangular shadow mask 20 is arranged on the inner side of the phosphor screen 3 to oppose it. An electron gun 13 for emitting three electron beams 12B, and 12G, and 12R that are arranged in a row to travel on the same horizontal plane is disposed in a neck 11 of the funnel 2. In the color cathode-ray tube, the three electron beams 12B, 12G, and 12R emitted from the electron gun 13 are deflected by a magnetic field generated by a deflecting yoke 14 mounted on the outer surface of the funnel 2, and the deflected electron beams scan the phosphor screen 3 through the shadow mask 20 in the horizontal and vertical directions, thereby displaying a color image.

Figure 2A:
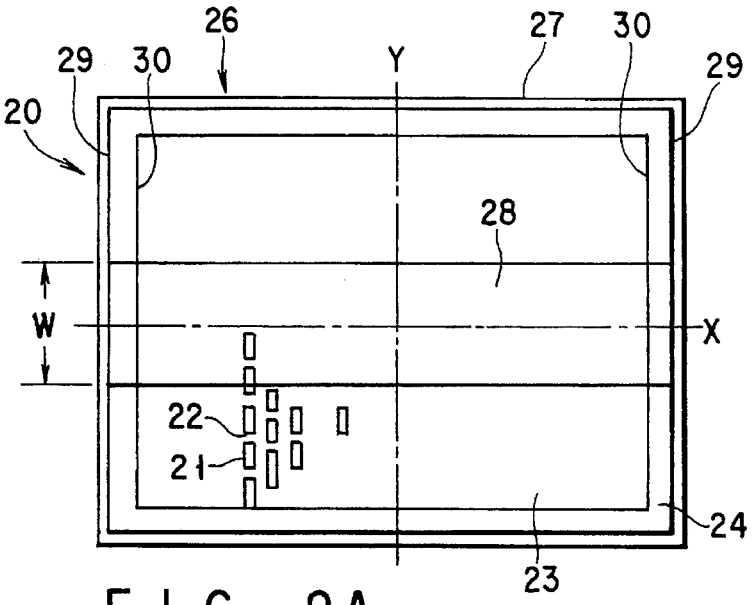
FIG. 2A is a plan view of a shadow mask.
Figure 2B:
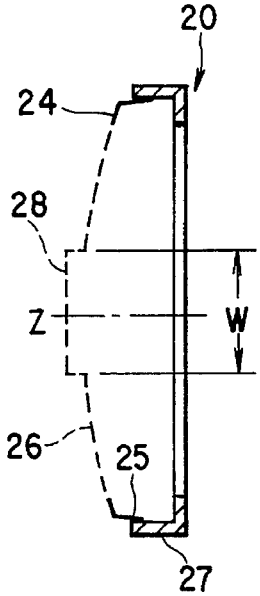
FIG. 2B is a sectional view of the shadow mask taken along the Y axis.
Figure 2C:
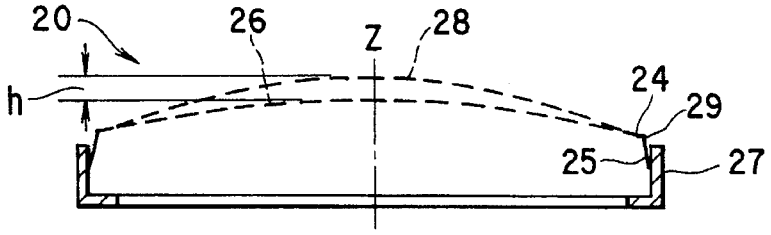
FIG. 2C is a sectional view of the shadow mask taken along the X axis.

As shown in FIGS. 2A to 2C, the shadow mask 20 has a substantially rectangular mask body 26 and a mask frame 27 on which the mask body 26 is mounted. The mask body 26 has a rectangular effective area 23 in which a large number of electron beam apertures are formed for passing the electron beams therethrough, a non-effective area 24 (a portion where electron beam apertures are not formed) surrounding the effective area 23, and a skirt portion 25 extending from the peripheral portion of the non-effective area 24 and fixed to the mask frame 27. The effective and non-effective areas 23 and 24 form a rectangular spherical portion as a whole which has a predetermined radius of curvature.

The mask body 26 has a mask center through which the tube axis Z of the color cathode-ray tube extends, a horizontal axis (X-axis) extending through the mask center, and a vertical axis (Y-axis) extending through the mask center and perpendicular to the horizontal axis. A large number of electron beam apertures 21 formed in the effective area 23 are arranged by aligning a plurality of vertical arrays, each obtained by arranging a plurality of electron beam apertures 21 in the Y-axis direction through bridges 22 having narrow width, in the horizontal direction (X-axis direction).

The shadow mask 20 having the above arrangement is supported on the inner side of the face panel 1 by coupling frame holders 9, constituted by elastic members and mounted on the mask frame 27, with stud pins 10 fixed to the face panel 1, such that the mask body 26 opposes the phosphor screen 3.

Furthermore, as shown in FIGS. 2A to 2C, a belt-shaped reinforcing bead 28 having a width W is formed on the mask body 26 of the shadow mask 20 and extends between the two end edges of the mask body 26 which are in parallel to the Y-axis. In this embodiment, the reinforcing bead 28 is formed at the central portion of the mask body 26 to be parallel to the X-axis, so that it traverses the effective area 23 and the non-effective area 24 surrounding the effective area 23 in the horizontal direction. The reinforcing bead 28 projects from the front surface of the mask body 26 toward the phosphor screen. Assuming that the projecting height of the reinforcing bead 28 at the central portion of the mask body 26 is defined as h and that boundaries 29 between the non-effective area 24 and the skirt portion 25 at the two end edges of the mask body 26 in the horizontal direction are respectively defined as reinforcing bead ends, the reinforcing bead 28 is formed such that its height h is gradually decreased from the central portion of the effective area 23 toward the respective boundaries 29 to be 0 at the respective boundaries 29. The height h of the reinforcing bead 28 at boundaries 30 between the effective and non-effective areas 23 and 24 is ⅔ or less the height h of the reinforcing bead 28 at the central portion of the effective area 23. The height h of the reinforcing bead 28 at the central portion of the effective area 23 is set to satisfy the following relationship:

$$0.1t \leq h \leq 3t$$

where t is the thickness of the mask body 26.

Figure 3:
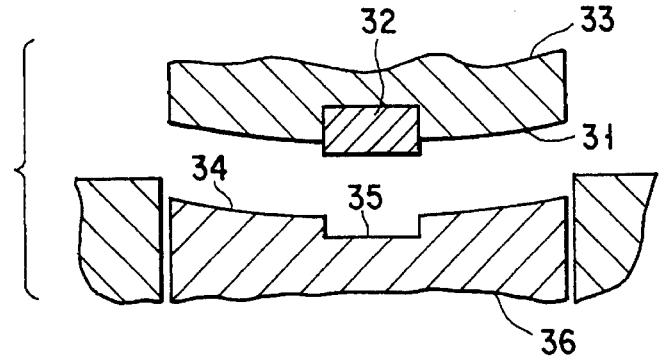

The mask body 26 having the above arrangement is fabricated by press-molding a flat mask, in which electron beam apertures are formed by photoetching, with a pressing unit, as shown in FIG. 3. The pressing unit has a punch 33 in which a molding die 32 for molding the reinforcing bead is mounted on a molding surface 31 that molds the effective area and the non-effective area surrounding the effective area, and a die 36 in which a recessed portion 35 corresponding to the molding die 32 that molds the reinforcing bead is formed in a molding surface 34 having the same radius of curvature as that of the molding surface 31 of the punch 33. The pressing unit press-molds the flat mask between the punch 33 and the die 36. The skirt portion 25 of the press-molded mask body 26 is welded to the mask frame 27 which is separately molded, thereby forming the shadow mask 20.

In the color cathode ray tube having the above arrangement, the reinforcing bead 28, the height h of which is gradually decreased from the central portion of the effective area 23 toward the boundaries 29 between the non-effective area 24 and the skirt portion 25 to become 0 at the boundaries 29, is formed on the mask body 26 of the shadow mask 20, and the height h of the reinforcing bead 28 at the central portion of the effective area 23 is regulated to satisfy the relationship of $0.1t \leqq h \leqq 3t$, where t is the thickness of the mask body 26, as described above. Therefore, an improvement in mechanical strength of the shadow mask, which is the primary object of the reinforcing bead 28, can be achieved, doming of the shadow mask can be sufficiently suppressed, and a degradation in outer appearance of the phosphor screen and a degradation in image equality, which are caused by the presence of the reinforcing bead, can be prevented.

More specifically, if a difference in height between the effective area 23 and the reinforcing bead 28 is large at the peripheral portion of the effective area 23, the arrangement of the phosphor layers is disordered at the peripheral portion of the phosphor screen which is formed by photographic printing that uses the shadow mask as the photomask, and the quality of the outer appearance of the phosphor screen is degraded. When, however, the reinforcing bead 28 of the shadow mask 20 is formed as in this embodiment, the difference in height between the effective area 23 and the reinforcing bead 28 at the peripheral portion of the effective area 23 becomes small, while a strength of the shadow mask 20 necessary for doming suppression of the shadow mask can be maintained, and a disorder in arrangement of the phosphor layers at the peripheral portion of the phosphor screen can be decreased, thereby decreasing a degradation in quality of the outer appearance of the phosphor screen. Also, beam landing errors at the peripheral portion of the phosphor screen 3 can also be decreased, so that a degradation in image quality can also be prevented.

When the height h of the reinforcing bead 28 at the central portion of the effective area 23 is regulated as described above, even if the reinforcing bead 28 is formed such that its height is gradually decreased from the central portion of the effective area 23 toward the boundaries 29 between the non-effective area 24 and the skirt portion 25 to be 0 at the boundaries 29, the shadow mask can sufficiently suppress doming.

Figure 4:
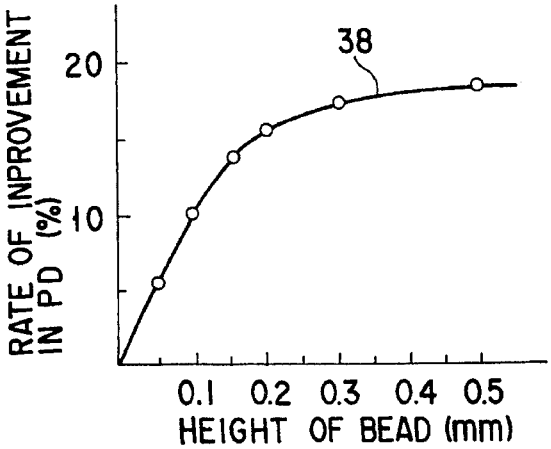

More specifically, the relationship between the height h of the reinforcing bead 28 and a purity drift (PD) caused by doming of the shadow mask is represented by a curve 38 shown in FIG. 4. The purity drift can be improved by about 5% only by forming the reinforcing bead to project from the effective area by 0.05 mm, and can be improved by about 10% by forming it to project from the effective area by 0.1 mm. This indicates that a sufficiently high doming suppressing effect can be obtained by setting the height h of the reinforcing bead 28 to be equal to 0.1t or more, where t is the thickness (t=1 mm) of the mask body 26. However, as is known from the curve 38, when the height h of the reinforcing bead 28 becomes 0.3 mm or more, the purity drift is not much improved for an increase in height h of the reinforcing bead. On the other hand, when the height h of the reinforcing bead 28 is increased, the disorder in arrangement of the phosphor layers becomes large not only at the peripheral portion of the phosphor screen but also at the intermediate and central portions of the phosphor screen, leading to an increase in beam landing errors. Therefore, the height h of the reinforcing bead 28 is 3t at maximum.

Figure 5:
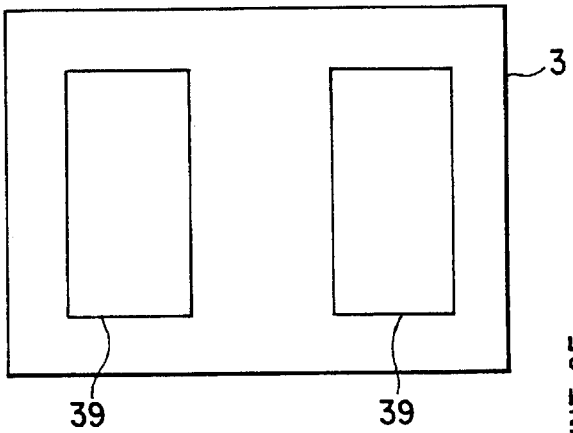
Figure 6:
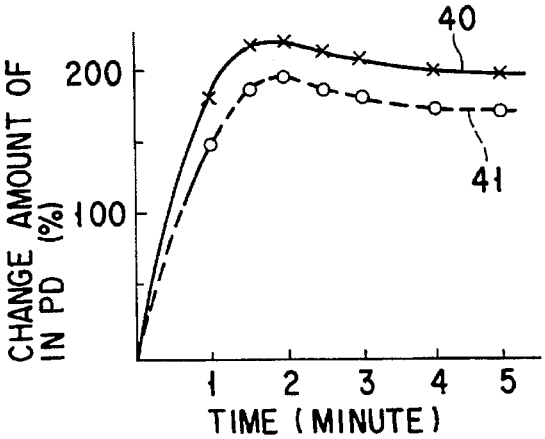

The purity drifts of 19- and 21-inch color cathode-ray tubes were measured. A shadow mask having a reinforcing bead having a height h of 0.15 mm and a shadow mask having no reinforcing bead were used, and white images 39 having a predetermined size were drawn at the right and left portions of each phosphor screen 3, as shown in FIG. 5, in the same manner as in the conventional forced purity drift test. FIG. 6 shows the results. Referring to FIG. 6, a curve 40 represents the purity drift of the shadow mask having a reinforcing bead, and a curve 41 represents the purity drift of the shadow mask having no reinforcing bead. As is known from the comparison between these curves 40 and 41, the purity drift was greatly improved by providing a reinforcing bead 28 to the shadow mask. For example, when 2 minutes passed from start of the operation, a change in purity drift of the color cathode-ray tube having a reinforcing bead was improved by about 13% that of the color cathode-ray tube not having a reinforcing bead.

The present invention is not limited to the embodiment described above, but various changes and modifications may be made within the spirit and scope of the invention.

Figure 7:
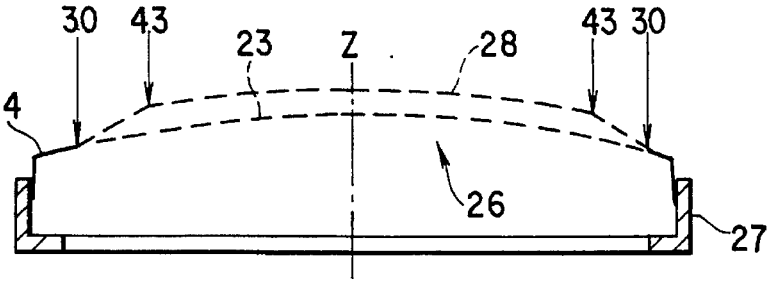
FIG. 7 is a sectional view of a shadow mask having a reinforcing bead according to a first modification.

In the above embodiment, the reinforcing bead traversing the effective area in the horizontal direction is formed on the mask body, such that its height h is gradually decreased from the central portion of the effective area toward the boundaries between the noneffective area and the skirt portion to be 0 at the boundaries. However, the reinforcing bead may be formed as shown in FIG. 7. More specifically, according to the first modification shown in FIG. 7, a reinforcing bead 28 is formed like a belt extending between the two end edges of an effective area 23 with respect to the horizontal direction along the horizontal axis (X-axis). A height h of the reinforcing bead 28 is constant from the central portion of the effective area 23 toward portions 43 in the vicinities of the two end edges of the effective area 23 in the horizontal direction, and is gradually decreased from the portions 43 toward the two end edges of the effective area 23 in the horizontal direction, i.e., toward boundaries 30 between the effective and non-effective areas 23 and 24, to be 0 at the boundaries 30. Even when the reinforcing bead 28 having this arrangement is used, doming of the shadow mask can be sufficiently suppressed, and a disorder in arrangement of the phosphor layers at the peripheral portion of the phosphor screen can be decreased, in the same manner as in the first embodiment described above, thereby improving the image quality.

Figure 8A:
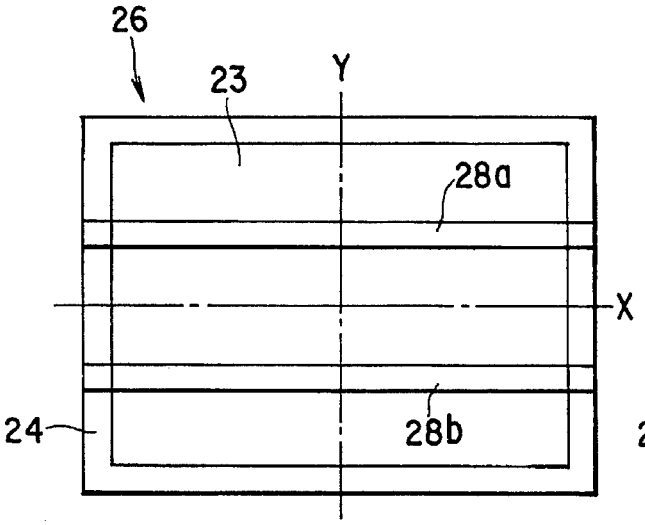
Figure 8B:
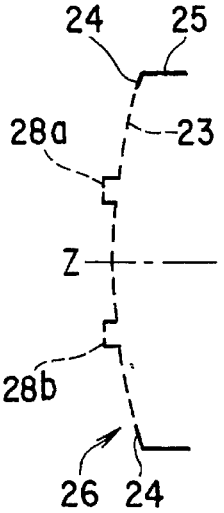
Figure 9A:
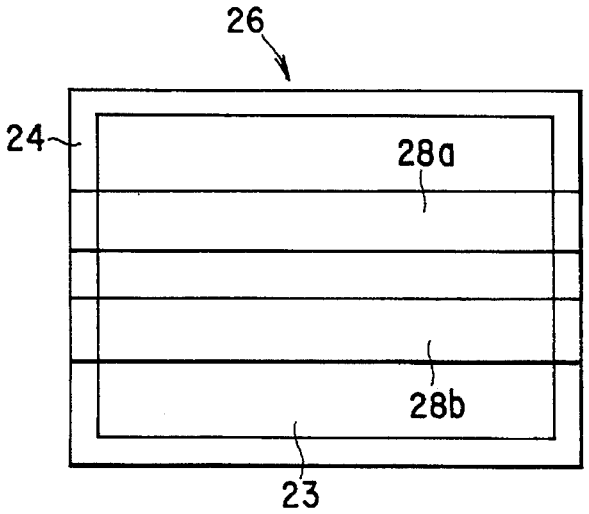
Figure 9B:
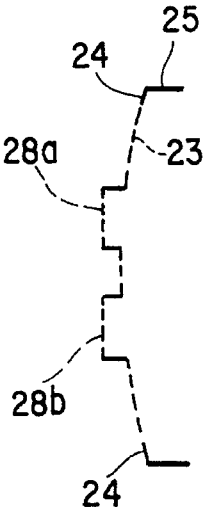

The number of the reinforcing beads 28 is not limited to one, but a plurality of reinforcing beads 28 may be formed. In this case, as shown in FIGS. 8A and 8B, a plurality of (two in FIGS. 8A and 8B) comparatively narrow reinforcing beads 28*a* and 28*b* may be formed to traverse an effective area 23 in the horizontal direction. Alternatively, as shown in FIGS. 9A and 9B, the reinforcing beads 28*a* and 28*b* may be formed to have comparatively large widths. It must be noted that the arrangement and shape of each of the reinforcing beads 28*a* and 28*b* must be the same as those of either the first embodiment or the first modification described above.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A color cathode ray tube comprising:

a face panel having a phosphor screen formed on an inner surface thereof; and a shadow mask disposed to oppose the phosphor screen with a predetermined gap, said shadow mask including:

a mask body having a substantially rectangular effective area, formed with a large number of electron beam apertures through which electron beams pass, a non-effective area surrounding the effective area, and a skirt portion extending from a peripheral portion of the non-effective area, the mask body having a center coinciding with a tube axis, horizontal and vertical axes extending through the center, and a belt-shaped reinforcing bead extending between two end edges of the mask body, which are in parallel to the vertical axis, through a central portion of the mask body and projecting from the effective area toward the phosphor screen, the reinforcing bead being formed such that a projecting height thereof is gradually decreased from the central portion of the mask body toward said two end edges of the mask body and such that the projecting height thereof at boundaries between the effective and noneffective areas becomes about not more than ⅔ a height of said reinforcing bead at the central portion of the mask body, and a mask frame mounted on the skirt portion of the mask body.

2. A color cathode-ray tube according to claim 1, wherein the reinforcing bead is formed such that the projecting height h thereof at the central portion of the mask body satisfies the following relationship:

$$0.1t \leqq h \leqq 3t$$

where t is a thickness of said mask body.

3. A color cathode-ray tube according to claim 1, wherein the reinforcing bead extends in parallel to the horizontal axis of the mask body.

4. A color cathode-ray tube according to claim 1, wherein the mask body has a plurality of reinforcing beads which extend in parallel to the horizontal axis of the mask body.

5. A color cathode ray tube comprising:

a face panel having a phosphor screen formed on an inner surface thereof; and a shadow mask disposed to oppose the phosphor screen with a predetermined gap, the shadow mask including:

a mask body having a substantially rectangular effective area formed with a large number of electron beam apertures through which electron beams pass, a non-effective area surrounding the effective area, and a skirt portion extending from a peripheral portion of the non-effective area, the mask body having a center coinciding with a tube axis, horizontal and vertical axes extending through the center, and a belt-shaped reinforcing bead extending between two end edges of the effective area, which are in parallel to the vertical axis, through a central portion of the mask body and projecting from the effective area toward the phosphor screen, the reinforcing bead being formed such that a projecting height thereof is constant from the central portion of the mask body toward portions in the vicinities of said two end edges of the effective area and is gradually decreased from said portions toward said two end edges of the effective area to be 0 at said two end edges of the effective area, and a mask frame mounted to the skirt portion of the mask body.

6. A color cathode-ray tube according to claim 5, wherein the reinforcing bead is formed such that the projecting height h thereof at the central portion of the mask body satisfies the following relationship:

$$0.1t \leqq h \leqq 3t$$

where t is a thickness of said mask body.

7. A color cathode-ray tube according to claim 5, wherein the reinforcing bead extends in parallel to the horizontal axis of the mask body.

8. A color cathode-ray tube according to claim 5, wherein the mask body has a plurality of reinforcing beads which extend in parallel to the horizontal axis of the mask body,.

* * * * *